United States Patent [19]

Suey

[11] 4,330,266

[45] May 18, 1982

[54] INSULATING TILE FOR REHEATING FURNACES

[76] Inventor: Paul V. Suey, 1043 Blackforest Rd., Pittsburgh, Pa. 15235

[21] Appl. No.: 216,268

[22] Filed: Dec. 15, 1980

[51] Int. Cl.[3] ..... F27D 3/02; D03D 49/24

[52] U.S. Cl. ..... 432/234; 52/506; 138/158

[58] Field of Search ..... 432/234; 52/506; 138/147, 158, 160, 161

[56] References Cited

U.S. PATENT DOCUMENTS

| | | | |
|---|---|---|---|
| 3,169,754 | 2/1965 | O'Reilly | 432/234 |
| 3,781,167 | 12/1973 | Ahonen | 432/234 |
| 4,070,151 | 1/1978 | Suey | 432/234 |
| 4,225,307 | 9/1980 | Magera | 432/234 |

*Primary Examiner*—John J. Camby

*Attorney, Agent, or Firm*—Parmelee, Miller, Welsh & Kratz

[57] ABSTRACT

Replaceable heat insulation is provided for water-cooled pipes comprising structural supports and skid rails in slab reheating furnaces and like high-temperature metallurgical furnaces wherein the insulation is comprised of two mating sections of convenient length arranged to surround or, in the case of skid rails, largely surround the water-cooled pipes, the sections having metal fastening at their confronting edges brought into interfitting relation by sliding one section along the pipe relative to the other with provision for tightening the sections against the surface of the pipe and bringing portions of the interfitting metal fastenings into heat conducting contact with the water-cooled pipe. When each pair of sections has been fitted about the pipe and interlocked, but before being tightened about the pipe, each pair after the first is slid as a unit along the pipe into abutting position against the exposed end of the preceding pair and when so positioned being then firmly tightened about the pipe. Removal of the refractory sections for replacement from time to time is easily effected without removal of fastenings that are welded to the surface of the water-cooled pipes.

6 Claims, 5 Drawing Figures

INSULATING TILE FOR REHEATING FURNACES

This invention is for an improvement in pipe insulating tile that are applied over water-cooled metal pipe exposed to high temperature, such as those used for work supports in metallurgical furnaces where heavy metal bodies are heated to a hot working temperature, most particularly but not exclusively, pusher-type continuous slab reheating furnaces.

Water-cooled pipe in such an environment are frequently referred to in the art as "wet pipe" and the purpose of the insulation is, most importantly, to protect the pipe from the high temperature and oxidation, and less importantly, to reduce heat loss from the furnace into the workpiece supporting structure on which the slabs, for example, are progressively moved through the furnace from a charging door to a discharge door in the process of being heated.

In my U.S. Pat. No. 4,070,151 I have shown a typical work support for a continuous slab reheating furnace in which the support comprises vertical support pipe, transverse crossover pipes and parallel skid rails or pipes having a rib along the top portion of these pipes not covered by insulation. The workpiece, such as a slab, extends crosswise of the furnace, resting on the exposed ribs on the skid rails. In this particular type of furnace each slab is placed on the rails at the charging door, pushing the preceding procession of slabs ahead of it, with the leading slab, then heated to hot working temperature, at or near white heat is removed from the furnace at the discharge door.

This procedure subjects the support and the insulation around the pipes to severe impact and vibration and if there is any looseness or play between the precast insulating sections and the pipes, severe destructive forces are set up that result in accelerated destruction of the tile or insulating sections. In any case, the insulation eventually breaks and disintegrates to the point where it must be removed and replaced with new sections, but any looseness between the insulation and the metal pipe which it encases shortens the effective life of the insulation.

In my U.S. Pat. No. 4,070,151 above referred to, the insulation is tightly secured to the pipe by flanged hollow studs located radially with the precast sections, and their inner ends are electrically welded to the surface of the pipe as the sections are progressively applied to the pipe. In that case, as is usual, the insulating sections are of a relatively short length which may be easily handled. Each section is of generally semi-circular shape so that they are applied end-to-end in confronting pairs for the full length of the respective pipes to be protected.

While insulation applied as disclosed in said patent has been quite successful, there has been some increasing demand for insulation that can be replaced when necessary by simply breaking away the worn and defective sections and replacing them without the need to remove the hollow studs attached by welding that remain after the body of the insulation has been broken away.

BRIEF DESCRIPTION OF THE INVENTION

The present invention, as before, comprises insulation formed of two complementary pairs of preformed tiles that are placed together on the pipe and the assembled pair slid endwise relative to each other into interlocking engagement, but the present invention provides in addition protected metal bolts or fastening means on one of the confronting edge surfaces of two complementary sections that can "snug-up" or tighten and lock the tiles about the pipe after they are joined together to thereby minimize vibration damage. Desirably, this fastening includes a heat conducting arcuate strip of metal that anchors the fastening in the tile, an area of which is in contact with the metal pipe to carry heat from the fastening into the water cooled pipe.

The invention may be more fully explained and understood by reference to the accompanying drawings in which.

Figure 1:
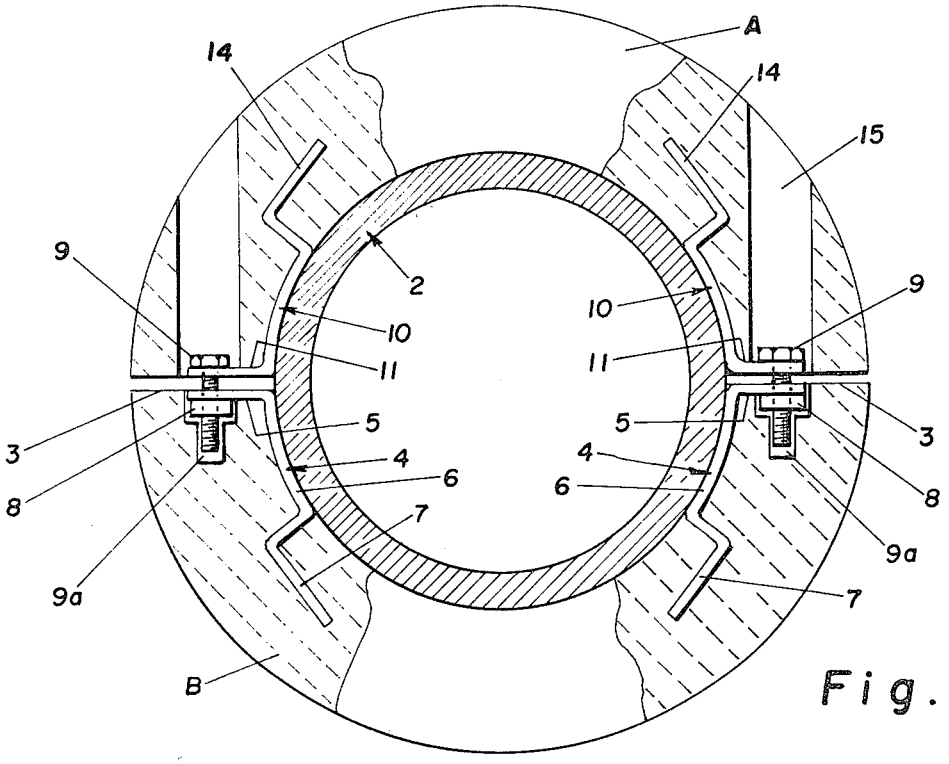
FIG. 1 is a transverse section through a crossover pipe, showing two mating sections of heat insulating molded refractory in position about the pipe.
Figure 2:
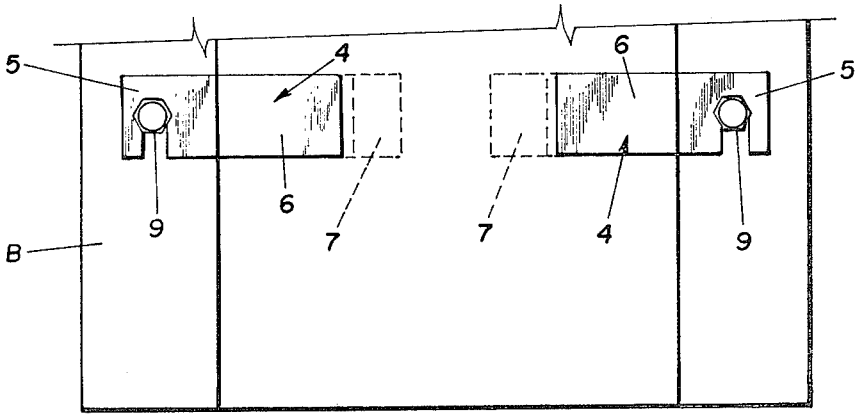
FIG. 2 is a top plan view of the bottom half section of the insulation shown in FIG. 1 apart from the pipe and from the mating upper half.
Figure 3:
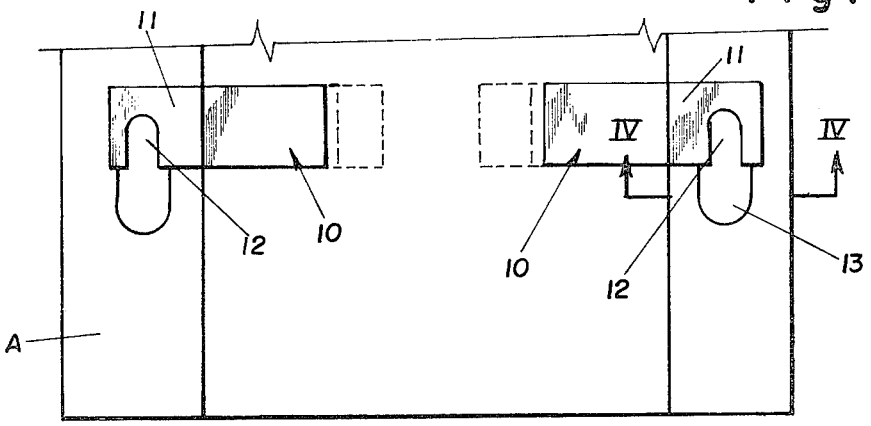
FIG. 3 is a similar plan view inverted with respect to FIG. 1 of the complementary upper half section of insulation.
Figure 4:
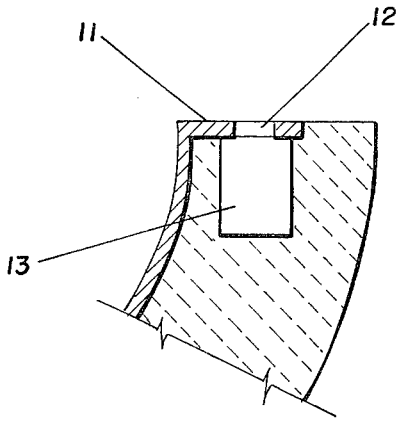
FIG. 4 is a fragmentary sectional view in the plane of line IV—IV of FIG. 3 of but one of the two joint structures of the upper tile of FIG. 1.
Figure 5:
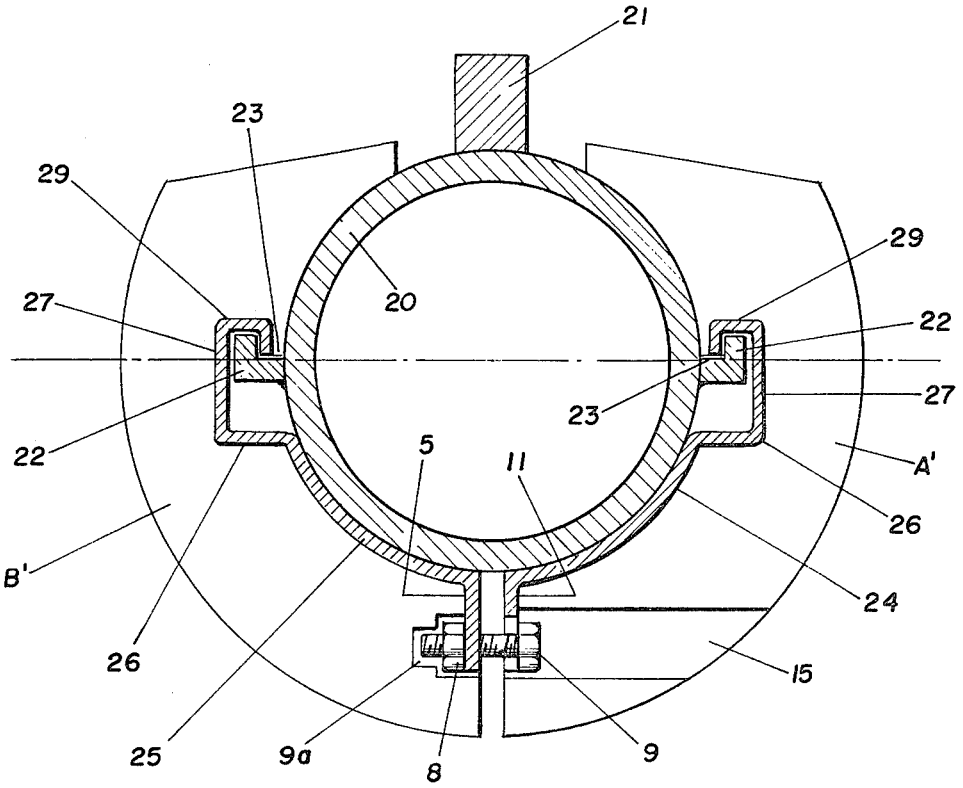

And, FIG. 5 is a view similar to FIG. 1 but showing the tile section on a skid-rail of the furnace where the sections separate on a vertical plane instead of a horizontal one, and the sections are designated "right" and "left" instead of bottom and top but in use will be the same size as FIG. 1.

The general arrangement of the furnace and the water cooled insulated pipe is essentially the same as disclosed in my said U.S. Pat. No. 4,070,151 of Jan. 14, 1978 which, so far as it may be relevant to this disclosure, is incorporated herein by reference.

Referring first to FIGS. 1 to 4, the "wet pipe" or water cooled steel pipe 2 is a typical crossover pipe, but except for the indicated directions might also be a vertical support pipe. The insulation surrounding the pipe comprises two complementary precast refractory semi-circular tile, the inner radius of which is close to the overall diameter of the pipe and the thickness or outer radius is typically of the order of $1\frac{1}{4}$ inches or slightly under 4 cm and the length of which is typically about 30 cm, or slightly under one foot. When a pair of these sections are placed face-to-face around the pipe they form a cylindrical refractory enclosure about the pipe and such pairs of tiles are placed end-to-end in abutting relation along the "wet" pipe. In FIG. 1 each of the two confronting faces of the two sections are in the plane of the horizontal diameter of the pipe, providing in this relation, an upper tile A and a lower tile B.

Each of the flat faces 3 of the lower tile are molded with a strip metal insert 4 having a radial flange 5 embedded in the flat face 3. The radial flange, or terminal 5, is at the end of a metal insert that has an arcuate section 6 substantially flush with the inner surface of the tile where, in use, it contacts the surface of the pipe 2. The opposite end portion 7 of this insert is outwardly offset and embedded in the refractory and serves to securely anchor the insert in the body of the refractory. The radial end flange 5 has a headed stud, the shank of which extends outwardly from the radial terminal of the insert so as to space the head from the metal. As here shown, the flange or terminal 5 has an internally threaded nut 8, such as a "hex" nut, welded thereto where the nut is embedded in the refractory, the threaded hole through the nut registering with an opening or slot through radial flange or terminal 5. A bolt 9, comprising the headed stud, passes through the hole with its threaded shank being screwed through the nut to form a socket or cavity in the refractory at 9*a*. After the refractory has set this bolt may be partially unscrewed to then project from the flange, as shown in FIG. 1.

Each of the two confronting faces 3 of the upper tile is likewise formed with an arcuate insert 10 formed of strip metal and having a radial terminal 11 thereon confronting the radial flange or terminal 5 embedded in the flat surface which it overlies. This terminal has a transverse slot 12 open at one end extending only part way across it and under the radial terminals there is a cavity 13, see FIGS. 3 and 4, elongated in the direction of the length of the tile.

The other end 14 of each arcuate insert is outwardly offset in the same way as the end portions 7 of the lower tile, to anchor the insert in the refractory. The upper tile has formed therein an opening 15 which extends in a direction tangential to the pipe and to the outer surface of the tile.

To apply a pair of tiles to a pipe when, of course, the furnace is down, the lower section B is held against the bottom of the pipe and the upper one placed above it with the then protruding head of the bolt entering the exposed end of cavity 13 and the upper tile A lowered against the edge surfaces of the lower one. The upper one is then slid lengthwise relative to the lower one and the shank of the bolt enters the slot 12 of the terminal portion of the upper metal insert. The lower tile will then be suspended from the upper one by means of the bolts, since the bolt heads cannot move downward through the respective slots 12. The combined sections may then, when necessary, be slid as a unit on the pipe to tightly abut the end of the previously applied pair of tiles on the pipe. When in place a socket type, long shank wrench, which may be torque driven to avoid excess pressure, is inerted to the respective tangential opening, tightening the bolt to draw the two sections of tile together and "snug up" the pair of tile to a point where subsequent vibration of the pipe from work load impact and travel will be minimized. While not shown in the drawings, there will be a similar pair of fastenings near the opposite end of the customary 11 to 12 long tiles. After a pair of tiles has been applied but before the furnace is put into use, the openings 15 may be filled with a ceramic mix, not shown.

For the tiles that protect the skid rail pipes a modification as shown in FIG. 5 is used. In this case the pipe 20 has a longitudinal extending rib 21 or rail along its full length on which the workpieces, extending crosswise of the rail actually rest and along which they slide. Because of this the refractory insulation cannot extend entirely around the pipe, as it does in FIG. 1, and the section A′ and B′ extend with diminishing thickness near the top covering the lower half of the pipe and the upper two quadrants, except for a small arc that includes the rib 21 and some space each side of it. The insulation is of diminishing thickness at the top in order to be clear of the workpieces that are being heated. If not quite of fully semicircular section, as in FIGS. 1 to 3, they each extend through an arc of more than 90°, about as much as 140°.

An angle bar 22 is welded to each side of the pipe with the outer leg of the angle extending vertically and the free edge of the horizontal leg is welded to the surface of the tube. The level of the top surface of the horizontal leg is substantially at the level of the horizontal diameter, incidated by broken line D—D, of the pipe. Thus there is provided a continuously extending upwardly opening channel 23 along the length of the pipe.

As in the first four figures, the tiles A′ and B′ have confronting faces which, however, are in a vertical plane instead of in a horizontal plane as in the previous figures. There are arcuate inserts or brackets molded into the two pipe contacting surfaces of the two tiles, these being designated 24 in tile B and 25 in tile A. Insert 24 has a radial extension or flange as does also insert 25. These radial extensions are exactly the same as in FIG. 1 and the joinder of these two surfaces is effected in exactly the same way so that identical reference numerals are used to designate corresponding parts.

While the confronting terminal portions of 24 and 25 are the same as previously described, the opposite ends of the inserts, instead of being outwardly offset and embedded in the insulation, each has an outwardly turned hook of channel-like formation, one wall of the channel, the lower one 26, 27 is the base of the channel and 28 is the other side wall but its free edge 29 is turned down to form a hook 30 which hooks over the vertical leg of the angle bar 22 into the channel 23. The opening of the hook, that is the unobstructed width of the channel-like formation 26, 27, 23 is adequate to enable the angle bar to enter the hook of the tile and the tile then lowered into interfitting engagement with the upturned leg of the angle. There must, of course, be a groove along the full surface of the tile to receive the angle when the tile is hooked into place, and to enable the pair of tiles when secured to the pipe to be slid along the pipe into tight end-trend abutting engagement with the previously applied pair of tiles.

After the successive pairs of tiles are hooked into place, plastic insulating mixture can be filled into the tangential opening 15 to protect the metal inserts and fastening bolts from oxidation. The arcuate metal inserts, contacting the surface of the wet pipe conduct heat from the metal connecting parts into the pipe to protect them from extreme heat.

I claim:

1. For use in insulating water cooled tubes in metallurgical workpiece heating furnaces, the invention comprising:

(a) a pair of refractory tiles, each having a concave inner face the curvature of which through an arc at least greater than 90° conforms to the curvature of the tube about which the tile is to be placed, and a generally concentric outer surface, the tiles of the pair having generally flat edge walls which are substantially radial to the center of curvature of the inner face of the tile, and which are in confronting relation when the pair of tiles are in place about the tube, (b) one tile of the pair having an arcuately extending metal insert embedded therein, the insert having a radial terminal at one end recessed into said flat edge surface of the tile in which it is embedded, said terminal having projecting therefrom a metal stud with a shank and an enlarged head, (c) the confronting flat edge surface of the second tile of the pair likewise having an arcuately extending metal insert, said insert also having a radial terminal recessed into the flat surface of its tile and which is transversely bifurcated to provide a slot extending part way across the terminal in the direction of the length of the tile, whereby, when the tiles are placed with their said confronting flat edge surfaces in face to face relation, the second tile may be moved in the direction of the length of the tile in such a manner that the shank of the stud in the first tile will be received in the bifurcation of the terminal of the slot in the terminal of the second tile, the head of the stud being larger than the width of the bifurcation to thereby connect the tiles against separation in direction radially of the tube to which they are to be applied and whereby they may thereafter be separated only by moving one tile relative to the other in the reverse direction to that by which they were joined, the flat edge surface of the second tile having an elongated cavity therein over only a portion of which the bifurcation in the radial terminal is located and the portion not covered by the bifurcation is positioned to initially receive the head of the stud before its shank enters the bifurcation and thereafter provide clearance for said head as the two tiles are first brought together for joining.

2. The improvement defined in claim 1 in which the bifurcation in the radial terminal of the second tile and the stud of the first are arranged with means to draw the sections more tightly together after the stud and bifurcation are initially engaged.

3. The improvement defined in claim 1 wherein the stud is a bolt threaded through the radial terminal of the insert in the first tile and the second tile has a tangentially extending opening from its exterior into said cavity through which a tool may be inserted for turning the bolt to tighten the sections after they are joined together.

4. The improvement defined in claim 1 wherein the arcuate length of the insert in each section are substantially flush with the concave inner surface of the tile in which it is located for conducting heat from the radial terminal into the water-cooled pipe to which the tiles are applied.

5. The invention defined in either claim 1 or claim 2 in which the tiles of each pair are semicircular to completely surround the water cooled pipe to which they are applied, and both longitudinal edges of each tile are flat and confront the flat edge surfaces of the other and wherein the inserts and the means that connect the edges of one to the other are on both edges of each of the respective tiles.

6. The invention defined in claim 1 in which the pair of tiles are for application to a skid rail pipe of a slab heating furnace wherein the pair of tile sections surround less than the full circumference of the skid rail but more than half of the circumference and the tiles are constructed with only one flat edge that confronts the flat edge of the other tile along the length of the bottom of the skid pipe to which the tiles are applied, the arcuate metal inserts of the respective tiles each extending approximately 90° from the radial terminal at the lower end to a down turned hook-like terminal embedded in the refractory material of the tile with the hook portion exposed at the inner surface of the tile for interlocking engagement with an oppositely turned hook-like ledge on the confronting side of the skid pipe.

* * * * *